US008270190B2

(12) United States Patent
Adragna

(10) Patent No.: US 8,270,190 B2
(45) Date of Patent: Sep. 18, 2012

(54) FIXED-OFF-TIME POWER FACTOR CORRECTION CONTROLLER

(75) Inventor: Claudio Adragna, Monza (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 255 days.

(21) Appl. No.: 12/366,498

(22) Filed: Feb. 5, 2009

(65) Prior Publication Data

US 2009/0146618 A1 Jun. 11, 2009

Related U.S. Application Data

(63) Continuation-in-part of application No. PCT/IT2006/000607, filed on Aug. 7, 2006.

(51) Int. Cl.
*G05F 1/70* (2006.01)
*H02M 7/217* (2006.01)
*G05F 1/613* (2006.01)

(52) U.S. Cl. ..... 363/89; 323/222; 323/288

(58) Field of Classification Search ..... 323/222, 323/285, 288, 207; 363/89
See application file for complete search history.

(56) References Cited

U.S. PATENT DOCUMENTS

| | | | | |
|---|---|---|---|---|
| 5,592,128 | A * | 1/1997 | Hwang | 331/61 |
| 5,982,156 | A * | 11/1999 | Weimer et al. | 323/222 |
| 6,049,473 | A * | 4/2000 | Jang et al. | 363/89 |
| 6,172,492 | B1 | 1/2001 | Pletcher et al. | |
| 6,198,265 | B1 * | 3/2001 | Stevenson | 323/288 |
| 6,285,174 | B1 * | 9/2001 | Suzuki | 323/288 |
| 6,420,861 | B2 * | 7/2002 | Ochi et al. | 323/288 |
| 6,657,417 | B1 * | 12/2003 | Hwang | 323/222 |
| 6,930,526 | B1 * | 8/2005 | Silva | 327/175 |
| 7,098,631 | B2 * | 8/2006 | Cohen | 323/222 |
| 7,106,038 | B1 * | 9/2006 | Xin-LeBlanc | 323/288 |
| 2004/0263140 | A1 | 12/2004 | Adragna et al. | |
| 2007/0108951 | A1 * | 5/2007 | Coleman | 323/282 |

* cited by examiner

*Primary Examiner* — Adolf Berhane
*Assistant Examiner* — Fred E Finch, III
(74) *Attorney, Agent, or Firm* — Seed IP Law Group PLLC

(57) ABSTRACT

A control device for a power factor correction device in forced switching power supplies is disclosed; the device for correcting the power factor comprises a converter and said control device is coupled with the converter to obtain from an input alternating line voltage a regulated output voltage. The converter comprises a power transistor and the control device comprises a driving circuit of said power transistor; the driving circuit comprises a timer suitable for setting the switch-off period of said power transistor. The timer is coupled with the alternating line voltage in input to the converter and is suitable for determining the switch-off period of the power transistor in function of the value of the alternating line voltage in input to the converter.

24 Claims, 3 Drawing Sheets

FIXED-OFF-TIME POWER FACTOR CORRECTION CONTROLLER

CROSS-REFERENCE TO RELATED APPLICATION

This application is a continuation-in-part of International Patent Application No. PCT/IT2006/000607, filed Aug. 7, 2006, now pending, which application is incorporated herein by reference in its entirety.

BACKGROUND

1. Technical Field

The present disclosure relates to a control device for a power factor correction device in forced switching power supplies.

2. Description of the Related Art

The use of devices is generally known for active correction of the power factor (PFC) for forced-switching power supplies employed in commonly used electronic apparatus such as computers, television sets, monitors, etc., and for supplying fluorescent lamps, i.e., stages of forced-switching pre-regulators that have the task of absorbing from the line a current that is almost sinusoidal and in phase with line voltage. Thus a forced-switching power supply unit of the current type comprises a PFC and a converter of continuous current into continuous current or DC-DC converter connected to the output of the PFC.

A forced-switching power supply unit of traditional type comprises a DC-DC converter and an input stage connected to the electric energy distribution line constituted by a full-wave diode rectifier bridge and by a capacitor connected immediately downstream so as to produce non-regulated continuous voltage from the alternating sinusoidal line voltage. The capacitor has sufficient capacity for the terminals thereof to have relatively small ripple with respect to a direct level. The rectifying diodes of the bridge will therefore conduct only for a small portion of each half cycle of the line voltage, as the instantaneous value of the latter is less than the voltage on the capacitor for the greater part of the cycle. As a result, the current absorbed by the line will consist of a series of narrow pulses the width of which is 5-10 times the resulting average value.

This has significant consequences: the current absorbed by the line has peak and root-mean-square (RMS) values that are much greater than in the case of absorption of sinusoidal current, line voltage is distorted through the effect of the pulsed absorption that is almost simultaneous with all the installations connected to the line, in the case of three-phase systems the current in the neutral conductor is greatly increased and there is little use of the energy potential of the electric-energy production system. In fact, the waveform of impulsive current is very rich in uneven harmonics that, although they do not contribute to the power delivered to the load, contribute to increasing the effective current absorbed from the line and therefore to increasing the dissipation of energy.

In quantitative terms, all this can be expressed both in terms of Power Factor (PF), defined as the ratio between the real power (the power that the power supply unit delivers to the load plus the power dissipated therein in the form of heat) and the apparent power (the product of the effective line voltage by the effective current absorbed) both in terms of Total Harmonic Distortion (THD), generally understood to be a percentage ratio between the energy associated with all the higher order harmonics and that associated to the fundamental harmonic. Typically, a power supply unit with a capacitive filter has a PF comprised between 0.4-0.6 and a THD greater than 100%.

A PFC arranged between the rectifier bridge and the input to the DC-DC converter enables a current to be absorbed from the line that is almost sinusoidal and in phase with the voltage, making the PF near 1 and reducing the THD. In order for the boost converter to operate correctly, the output voltage generated must always be greater than the input voltage. In the most typical embodiment thereof, in a PFC pre-regulator the output voltage is fixed around 400V in such a way as to be greater than the line peak voltage along the entire variation interval thereof (from 124.5 to 373.4 V in the case of a universal supply). In another embodiment, that of the so-called "boost follower" or "tracking boost", the output voltage is set at a value that depends on the effective input voltage, but which is nevertheless greater than peak voltage.

Alongside the two traditional control methods of a PFC pre-regulator, i.e., pulse width modulation (PWM) at fixed frequency (FF) of "average current-mode" type with continuous conduction of current into the inductor (CCM) suitable for high power, and variable frequency PWM control of "peak current-mode" type, is a "Transition Mode" (TM) in which the system works at the border between continuous current mode (CCM) and discontinuous current mode (DCM) for conducting current into the inductor, suitable for lower power levels. Recently, the so-called "constant Toff control" or "Fixed-Off-Time" (FOT) control has had growing success, where Toff is the switch-off time of the power transistor. The reason for the interest in this method, especially during the critical power band (from 150 to 350 W), where the selection between TM and FF-CCM control types is often complex, is due to the fact that it combines the simplicity and low cost of the TM approach with the capacity to carry power (or the best current form factor) and the low content of radio frequency injected into the energy distribution line of the CCM/FF approach.

The FOT methodology consists of using the "peak current-mode" type control, like that of the TM systems, and of controlling the power switch of the converter so that in each switching cycle it remains switched off for a fixed time and the feedback used to regulate the output voltage of the PFC operates only on the duration of the switch-on of the switch.

In FIG. 1 there is shown schematically a constant PFC to Toff pre-regulating phase comprising a boost converter 20 and a control device 1. The boost converter 20 comprises a full wave rectifier bridge 2 having in input an alternating line voltage Vin, a capacitor C1 (that acts as a filter for the high frequency) having the terminals connected to the terminals of the diode bridge 2, an inductance L connected to a terminal of the capacitor C1, a power MOS transistor M having the drain terminal connected to a terminal of the inductance L downstream of the latter and having the source terminal coupled with ground by means of a resistance Rs suitable for enabling the current to be read that flows in the transistor M, a diode D having the anode connected to the common terminal of the inductance L and of the transistor M and the cathode connected to a capacitor Co having the other terminal connected to ground. The boost converter 20 generates a direct output voltage Vout on the capacitor Co that is the input voltage of a user stage that is cascade-connected, e.g., a DC-DC converter.

The control device 1 has to maintain the output voltage Vout at a constant value by means of a feedback control action. The control device 1 comprises an operational error amplifier 3 that is suitable for comparing part of the output voltage Vout, i.e., the voltage Vr given by Vr=R2*Vout/(R2+R1) (where the resistances R1 and R2 are serially connected to one another and are connected in parallel to the capacitor Co) with a reference voltage Vref, for example of the value 2.5V, and suitable for generating an error signal Se that is proportional to the difference between them. The output voltage Vout has a ripple and a frequency that is twice that of the line and is imposed on the continuous value. If, nevertheless, the bandwidth of the error amplifier is reduced significantly, (typically below 20 Hz) by means of the use of a suitable compensating network comprising at least a capacitor and having almost stationary operation, i.e., with effective input voltage and output load that are constant, this ripple will be greatly attenuated and the error signal will become constant.

The error signal Se is sent to a multiplier 4 where it is multiplied by a signal Vi given by a part of the line voltage rectified by the diode bridge 2. At the output of the multiplier 4 there is present a signal Imolt given by a rectified sinusoid, the width of which depends on the effective line voltage and on the error signal Se. Said signal Imolt represents the sinusoidal reference for the modulation PWM. Said signal is an input signal into the non-inverting terminal of a comparator 6 at the inverting input of which there is the voltage on the resistance Rs that is proportional to the current $I_L$.

If the input signals entering the comparator 6 are equal the comparator 6 sends a signal to a control block 10 that is suitable for driving the transistor M and which in this case switches it off; so the output of the multiplier produces the peak current of the MOS transistor M that is enveloped by a rectified sinusoid. The block 10 comprises a set-reset flip-flop 11 having the reset input R that is the output signal from the comparator 6, the input set S, that is an output signal from a timer 13 and having an output signal Q. The signal Q is sent as an input to a driver 12 that commands switching on or off of the transistor M. The signal Q activates the timer 13, which after a preset period of time Toff has elapsed, sends a pulse to the input set S of the flip-flop 11 causing the transistor M to switch on. The period of time Toff can be modified from the exterior using a controller 14.

During the period of time Toff in which the transistor M is switched off the inductor L discharges the energy stored therein onto the load. If the time Toff is sufficient to discharge completely the inductor L in that switching cycle, operation will be of DCM type, otherwise operation will be of the CCM type.

The current absorbed from the line will be the low-frequency component of the current of the inductor L, i.e., the average current per switching cycle (the switching frequency component is almost totally eliminated by the line filter located at the input of the boost converter stage, which is always present in compliance with electromagnetic compatibility regulations). As the inductor current is enveloped by a sinusoid, low-frequency currency will have a sinusoidal trend. The control acts by modulating the duration of the switched-on period Ton but maintaining the switch-off period Toff constant, so that the operating frequency of the pre-regulator will vary from cycle to cycle according to the variation of the alternating line voltage, in particular, it varies in function of sen$\theta$ with $\theta$ being the phase angle of the alternating line voltage.

BRIEF SUMMARY

One embodiment is a control device for a power factor correction device in forced switching power supplies that is different from known ones.

One embodiment is a control device for a power factor correction device in forced switching power supplies, said device for correcting the power factor comprising a converter and said control device being coupled with the converter to obtain from an input alternating line voltage a regulated output voltage, said converter comprising a power transistor and said control device comprising a driving circuit of said power transistor, said driving circuit comprising a timer suitable for setting the switch-off period of said power transistor, characterized in that said timer is coupled with the alternating line voltage in input to the converter and is suitable for determining said switch-off period of the power transistor in function of the value of the alternating line voltage in input to the converter.

BRIEF DESCRIPTION OF THE SEVERAL VIEWS OF THE DRAWINGS

The features and advantages of the present disclosure will be clear from the following detailed disclosure of a practical embodiment, illustrated by way of non-limitative example in the attached drawings, in which.

DETAILED DESCRIPTION

Figure 1:
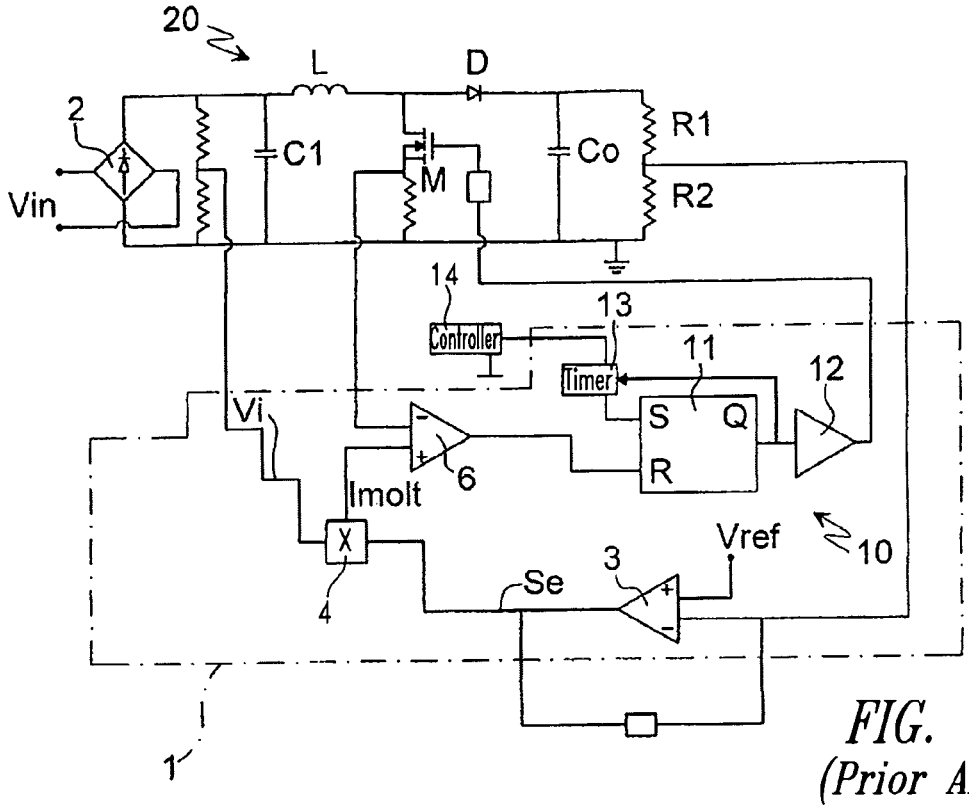
FIG. 1 (Prior Art)
FIG. 1 shows schematically a PFC pre-regulating stage according to the prior art.
Figure 2:
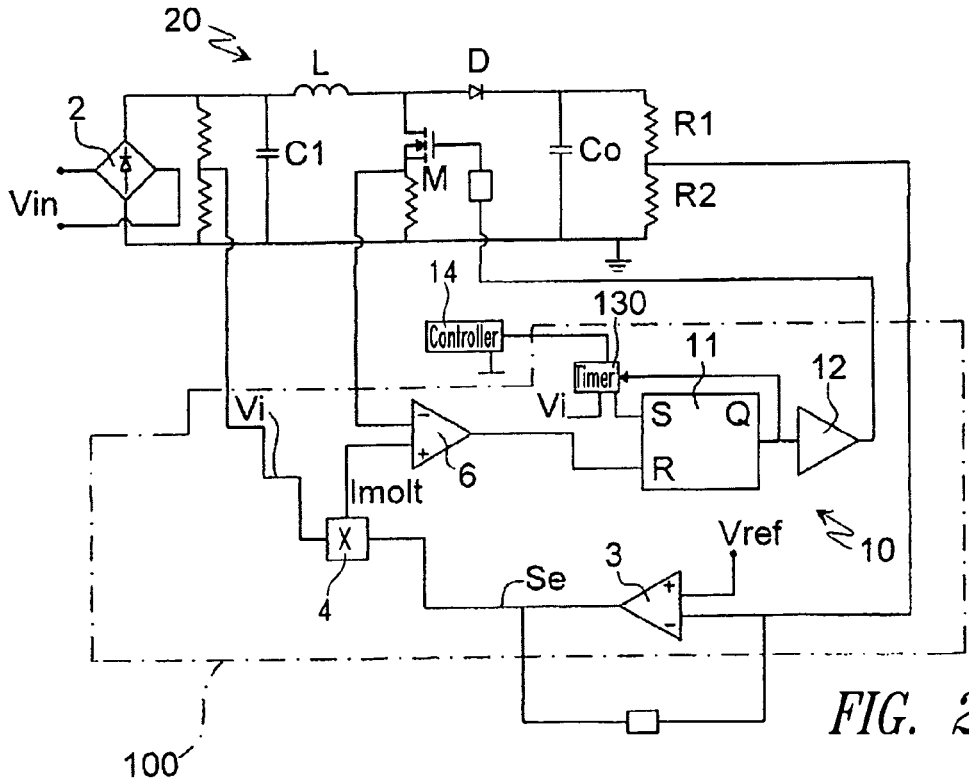
FIG. 2 shows schematically a PFC pre-regulating stage according to one embodiment.

In FIG. 2 there is schematically shown a constant Toff PFC pre-regulating stage comprising a boost converter 20 and a control device 100 according to. The PFC pre-regulating stage in FIG. 2 differs from the PFC pre-regulating stage in FIG. 1 by the fact that the control device 100 comprises a timer 130 having in input, in addition to the output signal Q from the flip-flop 11 and the output signal from the controller 14, the signal Vi, i.e., a signal constituting an instantaneous value of the line voltage rectified by the diode bridge 2. The idea behind the device in FIG. 2 is to control a PFC stage with "peak-current-mode" control maintaining the time in which the transistor M is switched off, i.e., the period of constant time Toff, but modulating this period of time with the instantaneous line voltage. In this way it is possible to keep operating frequency constant in the context of each line cycle, fixed at a value, at least until operation is of CCM type, regardless of effective line voltage and of loading conditions. It is possible for this operating frequency to be set by the user.

In order to modulate the time Toff for obtaining a frequency that is independent of the instantaneous line voltage, it is possible to use the balance equation of the voltage at the terminals of the inductor L in the operating hypothesis of CCM type:

$$Ton*Vpk\sin(\theta)=Toff(Vout-Vpk\sin(\theta))$$

where Ton is the duration of power switch-on, Vpk is peak line voltage, Vout is (regulated) output voltage, θ the phase angle of the line voltage. By solving the period of time Ton and calculating the switching period Tsw, there is obtained:

$$Tsw = Ton + Toff = \frac{Vout}{Vpk\sin(\vartheta)}Toff.$$

Thus, if the period of time Toff is varied proportionally to the instantaneous line voltage, i.e., if Toff=K*Vpk sin(θ) a period of switching time Tsw that is constant and equal to K·Vout will be obtained. The implicit hypothesis made on the output load is that it is such that inductor operation is of CCM type.

Figure 3A:
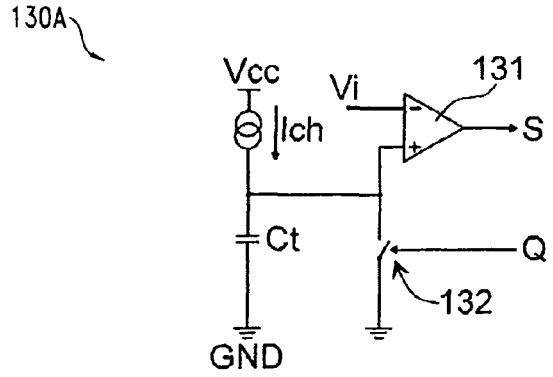
FIG. 3*a* shows a timer of the control device according to one embodiment.

In FIG. 3*a* there is shown a timer 130A according to a first embodiment. The timer 130A of said figure comprises a capacitor Ct, which is normally outside the control device 100, which is charged by means of a constant current generator Ich connected to the supply voltage; the capacitor Ct has a terminal connected to ground GND. The timer 130A comprises a comparator 131 having the non-inverting terminal connected to the terminal that is common to the capacitor Ct and to the constant current generator Ich and to the inverting input terminal connected to the voltage V; the output of the comparator 131 is the signal set S of the flip-flop 11. The timer 130A also comprises a switch 132 suitable for enabling the discharge to ground GND of the capacitor Ct when the output signal Q from the flip-flop is high; so the switch 132 is normally open during the period of switch-off time Toff whilst it is closed during the period of switch-on time Ton of the transistor M. The signal set S that enables switch-on of the transistor M is sent when the voltage Vt on the capacitor Ct reaches the voltage V1; as Vt=Ich*Toff/Ct and Vi=K*Vpk sin(θ) there is obtained Toff=Ct*K*Vpk sin(θ)/Ich so the period of switching time is Tsw=K*Ct*Vout/Ich, which is constant as Ich and Vout are constant. Calibration of the period of switching time Tsw depends on the factors K and Ct if the capacitor Ct is external to the control device 100.

Figure 3B:
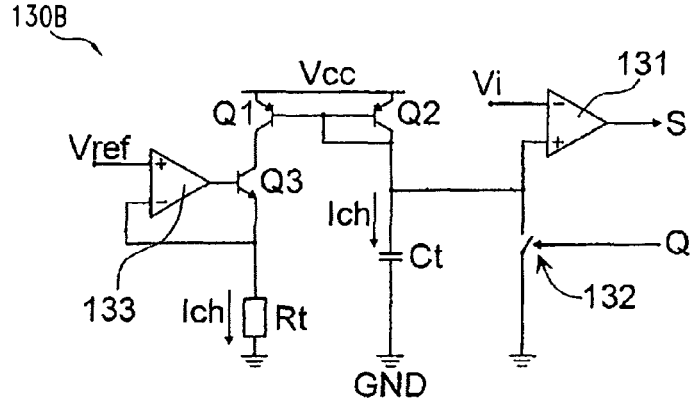
FIG. 3*b* shows another timer of the control device according to one embodiment.
Figure 4:
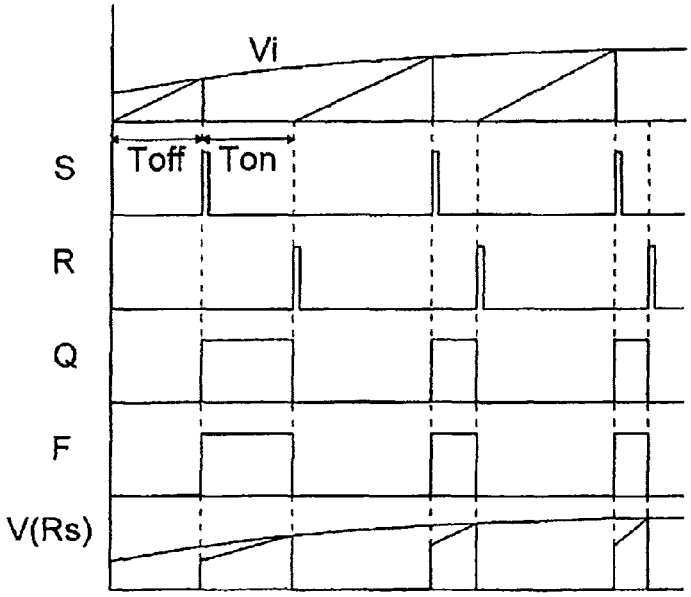
FIG. 4 shows the signals in question in the control device according to one embodiment.

In FIG. 3*b* there is shown another type of timer 130B according to a second embodiment. The timer 130B of said figure differs from the one in the preceding figure because the capacitor Ct is inside the control circuit 100 and the current Ich is defined from the exterior by means of a resistance Rt connected to ground GND and to the inverting input of an operational amplifier 133 having at the non-inverting input a reference voltage Vref and the output connected to the base terminal of a bipolar transistor Q3 having the emitter terminal connected to the inverting input terminal of the amplifier 133 and the collector terminal connected to a mirror Q1-Q2 suitable for mirroring on the capacitor Ct the current Ich present on the resistance Rt. In this case, as Ich=Vref/Rt, calibration of the period of switching time Tsw depends on the factors K and Rt. In FIG. 4 there are shown the trends of the signals Vi, S, R, Q, of the output signal F from the driver 12 and of the signal V(Rs) that is the voltage on the resistance Rs.

With the "peak-current-mode" control the current peaks in the inductor L are enveloped by a sinusoid. The line current, i.e., the low-frequency component of the current in the inductor, can be determined by assessing the average value of the current in the context of each switching cycle, in function of the phase angle θ (0<θ<π). This average value can be obtained as the difference of the peak value less half of the ripple:

$$I_{avg}(\theta) = I_{peak}(\theta) - \frac{1}{2}\cdot\Delta I(\theta).$$

By definition, $I_{peak}(\theta)$=Ipk·sin(θ); for the ripple, there will be obtained:

$$\Delta I(\theta) = \frac{K\cdot Vout^2}{L}\cdot(1-\rho\cdot\sin(\theta))\cdot\rho\cdot\sin(\theta),$$

where there is indicated with ρ the ratio pk/Vout, which, taking into account that Tsw=K·Vout, becomes:

$$\Delta I(\theta) = \frac{Vout}{L\cdot f_{SW}}\cdot(1-\rho\cdot\sin(\theta))\cdot\rho\cdot\sin(\theta).$$

This expression is identical, as was to be expected, to the known expression for a boost PFC that operates in CCM at constant frequency. Similarly, maximum width of ΔI(θ) will be obtained when the instantaneous line voltage is equal to half the output voltage, i.e., for ρ·sin(θ)=0.5 and will be equal to:

$$\Delta I_{max} = \frac{Vout}{4\cdot L\cdot f_{SW}}.$$

Definitively, line current will have the form:

$$I_{avg}(\theta) = Ipk\cdot\sin(\theta) - \frac{Vout}{2\cdot L\cdot f_{SW}}\cdot(1-\rho\cdot\sin(\theta))\cdot\rho\cdot\sin(\theta),$$

and consequently, will have a distortion the width of which is larger the larger the parameter ρ is. Consequently, this distortion will be small with low line voltage whilst it will be more accentuated at high line voltage.

It should be noted that CCM operation will be obtained until:

$$I_{peak}(\theta) - \Delta I(\theta) = Ipk\cdot\sin(\theta) - \frac{Vout}{L\cdot f_{SW}}\cdot(1-\rho\cdot\sin(\theta))\cdot\rho\cdot\sin(\theta) \geq 0$$

that is $$\sin(\theta) \geq \frac{Vout\rho - Ipk*L*f_{SW}}{Vout*\rho^2}$$

otherwise there is DCM operation. If the numerator of the fraction is negative the aforementioned condition will always be met, so there will be CCM operation in the entire line cycle. The condition for constant CCM operation and therefore for constant frequency throughout the whole line cycle is therefore:

$$Vout\cdot\rho - Ipk\cdot L\cdot f_{SW} \leq 0.$$

If either the last condition or the preceding condition is not met there will be a line cycle zone in which DCM operation will be obtained. In this case in this zone the system works with constant Ton, which is obtainable from:

$$Vpk \cdot \sin(\theta) = L \cdot \frac{Ipk}{T_{ON}} \cdot \sin(\theta) \Longrightarrow T_{ON} = L \cdot \frac{Ipk}{Vpk}$$

and no longer at a constant frequency. Still in this zone, the switching period will be:

$$\begin{aligned} T_{SW_{DCM}} &= T_{ON} + T_{OFF} \\ &= L \cdot \frac{Ipk}{Vpk} + K \cdot Vpk \cdot \sin(\theta) \\ &= L \cdot \frac{Ipk}{Vpk} + T_{SW} \cdot \frac{Vpk}{Vout} \cdot \sin(\theta) \end{aligned}$$

whilst the duration of demagnetizing will be:

$$T_{FW} = L \cdot \frac{Ipk \cdot \sin(\theta)}{Vout - Vpk \cdot \sin(\theta)} = T_{ON} \cdot \frac{Vpk \cdot \sin(\theta)}{Vout - Vpk \cdot \sin(\theta)}$$

and consequently the conduction duty cycle of the current in the inductor will be:

$$\begin{aligned} D_L(\theta) &= \frac{T_{ON} + T_{FW}}{T_{SW_{DCM}}} \\ &= \frac{1}{(1 - \rho \cdot \sin(\theta)) \cdot \left(1 + \rho^2 \cdot \sin(\theta) \cdot \frac{Vout}{f_{SW} \cdot L \cdot Ipk}\right)} \end{aligned}$$

Lastly, the average current of the inductor will be given by:

$$\begin{aligned} I_{avgDCM}(\theta) &= \frac{1}{2} D_L(\theta) \cdot Ipk \cdot \sin(\theta) \\ &= \frac{Ipk \cdot \sin(\theta)}{2 \cdot (1 - \rho \cdot \sin(\theta)) \cdot \left(1 + \rho^2 \cdot \sin(\theta) \cdot \frac{Vout}{f_{SW} \cdot L \cdot Ipk}\right)} \end{aligned}$$

Remembering that in reality it is not possible to have Toff>Toffmin, there will exist a zone around the zeroes of the line voltage in which the switching frequency will return to being almost constant.

The Ipk value can be determined by remembering that if the average value of product line voltage Vpk·sin(θ)= ρ·Vout·sin(θ) by line current $I_{avg}(\theta)$ is considered, the latter will be equal to the transiting power Pin. Thus if the ratio sin θ is achieved for the operation CCM and there is only CCM operation in the entire line cycle:

$$Pin = \frac{1}{\pi} \cdot \int_0^{\pi} \rho \cdot Vout \cdot \sin(\theta) \cdot \left[ Ipk \cdot \sin(\theta) - \frac{Vout}{2 \cdot L \cdot f_{SW}} \cdot \frac{}{(1 - \rho \cdot \sin(\theta)) \cdot \rho \cdot \sin(\theta)} \right] \cdot d\theta$$

By developing the integral and developing the Pin expression that was solved with respect to Ipk, there is obtained:

$$Ipk = \frac{2 \cdot Pin}{\rho \cdot Vout} + \frac{1}{6} \cdot \rho \cdot \frac{3 \cdot \pi - 8 \cdot \rho}{\pi \cdot L \cdot f_{SW}} \cdot Vout$$

The peak of the line voltage will be equal to $I_{avg}(\theta)$ with θ=π/2:

$$I_{avgpk} = \frac{2 \cdot Pin}{\rho \cdot Vout} + \frac{1}{6} \cdot \rho^2 \cdot \frac{3 \cdot \pi - 8}{\pi \cdot L \cdot f_{SW}} \cdot Vout$$

It should be observed that the first addendum is non other than the term 2·Pin/Vpk that is typical of the expression of the peak current in undistorted status.

The ratio between the maximum ripple ΔImax and the peak current in the inductor Ipk, evaluated at minimum line voltage and with the maximum load, the typical design parameter indicated by Kr, is given by:

$$Kr = \frac{\frac{Vout}{4 \cdot L \cdot f_{SW}}}{\left(\frac{2 \cdot Pinmax}{\rho_{min} \cdot Vout} + \frac{1}{6} \cdot \rho_{min} \cdot \frac{3 \cdot \pi - 8 \cdot \rho_{min}}{\pi \cdot L \cdot f_{SW}} \cdot Vout\right)}$$

from which the required inductance value can be obtained:

$$L = \frac{Vout^2}{4 \cdot Pinmax \cdot f_{SW}} \cdot \left[\frac{\rho_{min}}{2 \cdot Kr} - \rho_{min}^2 \cdot \left(1 - \frac{8 \cdot \rho_{min}}{3 \cdot \pi}\right)\right]$$

By replacing the value of L in a preceding ratio for solely CCM operation, taking account of the expression obtained for Ipk, there is obtained:

$$\frac{1}{6} \cdot \rho \cdot \frac{(3 \cdot \pi + 8 \cdot \rho)}{\pi} \cdot Vout - 2 \cdot Pin \cdot L \cdot \frac{f_{SW}}{\rho \cdot Vout} \leq 0$$

For an assigned system, i.e., in which L, $f_{sw}$, Vout are already known, the condition can be expressed in terms of input power Pin, for a given input voltage, i.e., through assigned ρ, or, in terms of input voltage, for assigned voltage Pin.

As a design formula, for an assigned maximum power Pinmax, it is desired to ensure that for at least at minimum line voltage operation is solely CCM. This condition may be translated into a condition on the maximum value of the coefficient Kr, obtaining:

$$Kr < \frac{1}{4 \cdot \rho_{min}}$$

Another design criterion could be that of requesting that at full load operation be of CCM type throughout the whole cycle, even at maximum input voltage. Finally, there is obtained:

$$Kr < \frac{2}{3} \cdot \rho_{min} \cdot \frac{\pi}{3 \cdot \pi \cdot (\rho_{max}^2 + \rho_{min}^2) + 8 \cdot (\rho_{max}^3 - \rho_{min}^3)}$$

If the condition always for the operation CCM is not met, on the basis of ratio of sin θ there can be defined a transition angle α that marks the transition from CCM to DCM and vice versa (CCM for $\alpha<\theta<\pi-\alpha$, DCM for $\theta<\alpha$ and $\theta>\pi-\alpha$):

$$\alpha = a\sin\left(\frac{Vout \cdot \rho - Ipk \cdot L \cdot f_{SW}}{Vout \cdot \rho^2}\right)$$

where, it should be noted, 1Ipk is not given by the expression first determined in the case of solely CCM operation. In the present mixed CCM-DCM operation case, Ipk can be determined by the expression of the power Pin.

Figure 5:
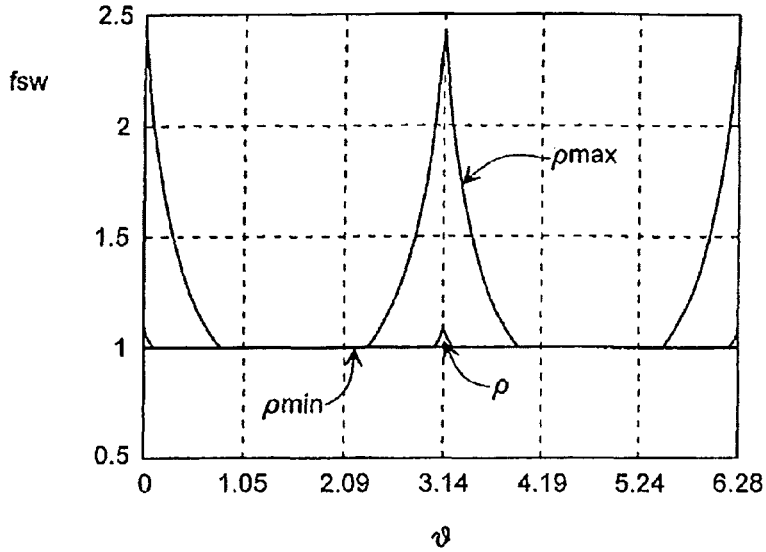
FIG. 5 shows the trend of the switching frequency for different input voltage values obtained with a simulation on the PFC pre-regulator with the control device according to one embodiment.

FIG. 5 shows the typical trend of the switching frequency of a practical embodiment of the circuit in FIG. 2, in which the block 130 is made with any of the modulators in FIG. 3*a* or 3*b*, for three different parameter values ρ ρmin, ρ and ρmax, corresponding to minimum input voltage, to the maximum and to the average thereof in a universal supply system (88-264 Vac).

Figure 6:
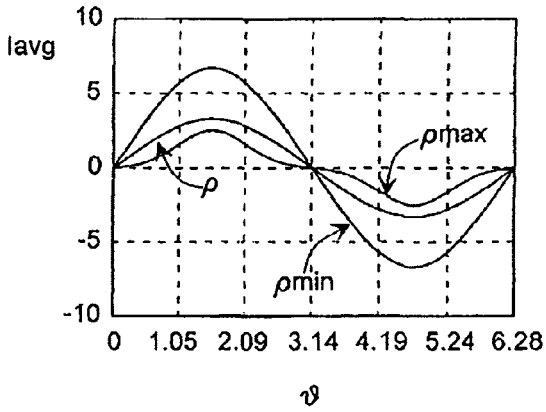
FIG. 6 shows the typical trend of the input current for different input voltage values obtained with a simulation on the PFC pre-regulator with the control device according to one embodiment.
Figure 7:
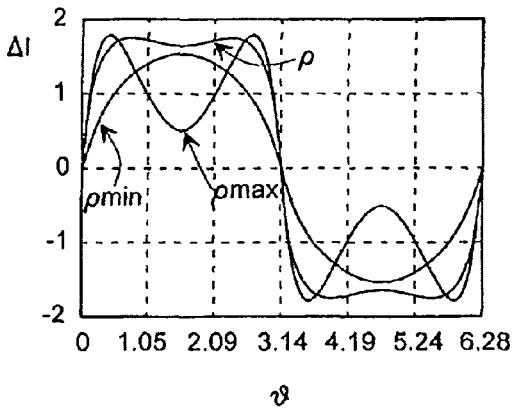
FIG. 7 shows the typical trend of the current ripple in the inductor for different input voltage values obtained with a simulation on the PFC pre-regulator with the control device according to one embodiment.

FIGS. 6 and 7 show the typical trend of the input current $I_{avg}$ and of the current ripple of the inductor ΔI for a practical embodiment of the circuit in FIG. 2, in which the block 130 is made with any one of the modulators in FIG. 3*a* or 3*b*, for three different values of the parameter ρ ρmin, ρ and ρmax corresponding to the minimum input voltage, to the maximum and to the average thereof in a universal supply system (88-264 Vac).

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A control device for a power factor correction device, said control device comprising:

a driving circuit configured to drive a power transistor of a converter of the power factor correction device without synchronization to a fixed frequency, said driving circuit having a timer to terminate a switch-off period of said power transistor, wherein said timer is coupled to a rectified alternating line voltage node in the converter and configured to terminate said switch-off period of the power transistor as a function of the rectified alternating line voltage independent of when a turn-off instant falls during a switch cycle of the power transistor, the timer including:

a capacitance configured to be charged by a charging current; and a comparator having a first input coupled to the capacitance, a second input configured to receive a voltage representative of the rectified alternating line voltage, and an output configured to be coupled to a control terminal of the power transistor.

2. A control device according to claim 1, wherein said timer is suitable for determining said switch-off period of the power transistor as a function of an output voltage from a rectifier of the converter.

3. A control device according to claim 2, wherein said timer comprises a current generator configured to charge the capacitance by a constant current and the comparator is configured to determine said switch-off period when said capacitance has a voltage that equals the output voltage from the rectifier.

4. A control device according to claim 2, wherein the comparator is configured to determine said switch-off period when a voltage of the capacitance, charged by a direct current, equals the output voltage from the rectifier.

5. A control device according to claim 4 wherein the timer includes:

a current generator configured to produce the charging current; and a current mirror configured to mirror the charging current to the capacitance.

6. A control device according to claim 5 wherein the current generator includes:

an operational amplifier having first and second inputs and an output, the first input being configured to be coupled to a reference voltage;

a resistance; and a switch having first and second conduction terminals and a control terminal, the control terminal being coupled to the output of the operational amplifier, the first conduction terminal being coupled to the current mirror, and the second conduction terminal being coupled to the resistance and to the second input of the operational amplifier.

7. A control device according to claim 2, wherein the switch-off period of said power transistor is proportional to the output voltage from the rectifier and the switch-off period is independent of a switch-on time duration of said power transistor.

8. A control device according to claim 1 wherein the drive circuit includes:

a flip-flop having an input coupled to an output of the comparator and an output configured to be coupled to the control terminal of the power transistor; and a switch having a control terminal and first and second conduction terminals, the first conduction terminal being coupled to the second input of the comparator, the second conduction terminal being coupled to a ground; and the control terminal of the switch being coupled to the output of the flip flop.

9. A control device according to claim 1, wherein the timer is configured to compare an internally generated voltage ramp to a scaled-down instantaneous input voltage.

10. A control device according to claim 1, wherein the switch-off period provides for a constant switching frequency of a boost converter independent of an instantaneous line voltage and independent of a loading condition of the boost converter.

11. A control device according to claim 10, wherein the constant switching frequency is user configurable.

12. A power factor correction device, comprising:

a converter configured to receive rectified alternating line voltage and including a power transistor; and a control device that includes a driving circuit configured to drive the power transistor, said driving circuit having a timer to end a switch-off period of said power transistor, wherein said timer is coupled to a node of the rectified alternating line voltage and configured to trigger an end of said switch-off period of the power transistor without synchronization to a fixed frequency and as a function of the rectified alternating line voltage, the timer including:

a capacitance configured to be charged by a charging current; and a comparator having a first input coupled to the capacitance, a second input configured to receive a voltage representative of the rectified alternating line voltage, and an output configured to be coupled to a control terminal of the power transistor.

13. A device according to claim 12, wherein said converter includes a rectifier configured generate the rectified alternating line voltage and produce an output voltage which is the voltage representative of an alternating line voltage and said timer is suitable for determining said switch-off period of the power transistor as a function of the output voltage from the rectifier.

14. A device according to claim 13, wherein said timer comprises a current generator configured to charge the capacitance by a constant current and the comparator is configured to determine said switch-off period when said capacitor has a voltage that equals the output voltage from the rectifier.

15. A device according to claim 13, wherein the comparator is configured to determine said switch-off period when a voltage of the capacitance, charged by a direct current, equals the output voltage from the rectifier.

16. A device according to claim 15 wherein the timer includes:

a current generator configured to produce the charging current; and a current mirror configured to mirror the charging current to the capacitance.

17. A device according to claim 16 wherein the current generator includes:

an operational amplifier having first and second inputs and an output, the first input being configured to be coupled to a reference voltage;

a resistance; and a switch having first and second conduction terminals and a control terminal, the control terminal being coupled to the output of the operational amplifier, the first conduction terminal being coupled to the current mirror, and the second conduction terminal being coupled to the resistance and to the second input of the operational amplifier.

18. A device according to claim 12 wherein the drive circuit includes:

a flip-flop having an input coupled to an output of the comparator and an output configured to be coupled to the control terminal of the power transistor; and a switch having a control terminal and first and second conduction terminals, the first conduction terminal being coupled to the second input of the comparator, the second conduction terminal being coupled to a ground; and the control terminal of the switch being coupled to the output of the flip flop.

19. A control device for a power factor correction device, said control device comprising:

driving means for driving a power transistor of a converter of the power factor correction device; and timing means for terminating a switch-off period of the power transistor based on a rectified alternating line voltage independent of a fixed frequency signal, the timing means including:

a capacitance configured to be charged by a charging current; and comparing means for comparing a voltage representative of the rectified alternating line voltage with a voltage of the capacitance and controlling the driving means based on the comparing.

20. A control device according to claim 19, wherein said timing means are for determining said switch-off period of the power transistor as a function of an output voltage from a rectifier of the converter.

21. A control device according to claim 19, wherein said timing means comprise current generating means for charging the capacitance by a constant current and the comparing means are for determining said switch-off period when said capacitance has a voltage that equals the voltage representative of the rectified alternating line voltage.

22. A control device according to claim 19, wherein the comparing means is configured to determine said switch-off period when the voltage of the capacitance, charged by a direct current, equals the voltage representative of the rectified alternating line voltage.

23. A control device according to claim 22 wherein the timing means includes:

a current generator configured to produce the charging current; and a current mirror configured to mirror the charging current to the capacitance.

24. A control device according to claim 23 wherein the current generator includes:

an operational amplifier having first and second inputs and an output, the first input being configured to be coupled to a reference voltage;

a resistance; and a switch having first and second conduction terminals and a control terminal, the control terminal being coupled to the output of the operational amplifier, the first conduction terminal being coupled to the current mirror, and the second conduction terminal being coupled to the resistance and to the second input of the operational amplifier.

* * * * *

UNITED STATES PATENT AND TRADEMARK OFFICE

CERTIFICATE OF CORRECTION

PATENT NO. : 8,270,190 B2
APPLICATION NO. : 12/366498
DATED : September 18, 2012
INVENTOR(S) : Claudio Adragna It is certified that error appears in the above-identified patent and that said Letters Patent is hereby corrected as shown below:

Column 9, Line 56:
"configured to terminate said switch-off period of the" should read, --configured to end said switch-off period of the--.

Signed and Sealed this
Eighteenth Day of December, 2012

David J. Kappos

David J. Kappos
*Director of the United States Patent and Trademark Office*